United States Patent [19]

Kober

[11] 4,405,120

[45] Sep. 20, 1983

[54] PRINTED CIRCUIT BOARD HOLDER

[75] Inventor: Marvin Kober, Spring Valley, N.Y.

[73] Assignee: O.K. Machine and Tool Corporation, New York, N.Y.

[21] Appl. No.: 270,971

[22] Filed: Jun. 5, 1981

[51] Int. Cl.[3] ..... B25B 1/04

[52] U.S. Cl. ..... 269/71; 269/74; 269/95; 269/246; 269/903

[58] Field of Search ..... 269/71, 74, 75, 77, 269/78, 903, 254 R, 254 CS, 246, 133, 95; 248/309 A, 176, 226.4, 415; 403/109, 289, 290

[56] References Cited

U.S. PATENT DOCUMENTS

| | | | |
|---|---|---|---|
| 2,019,789 | 11/1935 | Mahannah | 269/71 |
| 2,265,794 | 12/1941 | Aske | 403/109 |
| 2,486,142 | 10/1949 | Fong | 269/254 R |
| 2,830,632 | 4/1958 | La Rouche | 269/133 |
| 3,941,363 | 3/1976 | Ogg | 269/254 CS |
| 4,012,155 | 3/1977 | Morris | 403/290 |

FOREIGN PATENT DOCUMENTS

| | | | |
|---|---|---|---|
| 1135433 | 12/1956 | France | 269/75 |

*Primary Examiner*—Robert C. Watson

[57] ABSTRACT

A printed circuit board holder of simple and low cost manufacture comprising on a base member a support rotatable over a full 360° and on the support jaws for clamping a single edge of the board, which jaws are pivotably mounted on the rotatable support so as to pivot over an arc exceeding 180°.

8 Claims, 6 Drawing Figures

PRINTED CIRCUIT BOARD HOLDER

This invention relates to a printed circuit board holder.

Known devices are generally of the vise type wherein opposed jaws movable toward one another by a rotatable lead screw are adapted to clamp the board while held in a generally horizontal position along opposite edges between the opposed vise jaws. Some limited tilting of the clamped board is possible by mounting the vise on an adjustable base usually employing an adjustable ball and socket joint. However, in such known board vise structures, the possible degrees of movement are limited. Normally, access is not readily available to both sides of the board, without reversing and reclamping the board. Moreover, the device is large and bulky, with an overall size exceeding that of the board. Such known devices are also complicated and expensive to manufacture.

The chief object of the invention is a relatively simple, low-cost holder for a printed circuit board and which allows a wide variety of movements of the clamped board.

Still a further object of the invention is a printed circuit board holder that will provide a full 360° rotation of the clamped board as well as a tilting or pivoting of the clamped board in a vertical plane over an angle exceeding 180° thereby allowing full access to both sides of the board.

These and other objects of the invention are realized in a novel printed circuit board holder in accordance with the invention comprising a base member, a rotatable vertical support mounted on the base member, and a jaw member pivotably mounted on the rotatable support and adapted to hold or clamp a single edge of the board, the holder being configured to allow pivoting of the clamped board over an arc exceeding 180°.

Other objects and advantages will become apparent from the following detailed description of one form of holder in accordance with the invention, taken in conjunction with the accompanying drawings wherein.

Figure 1:
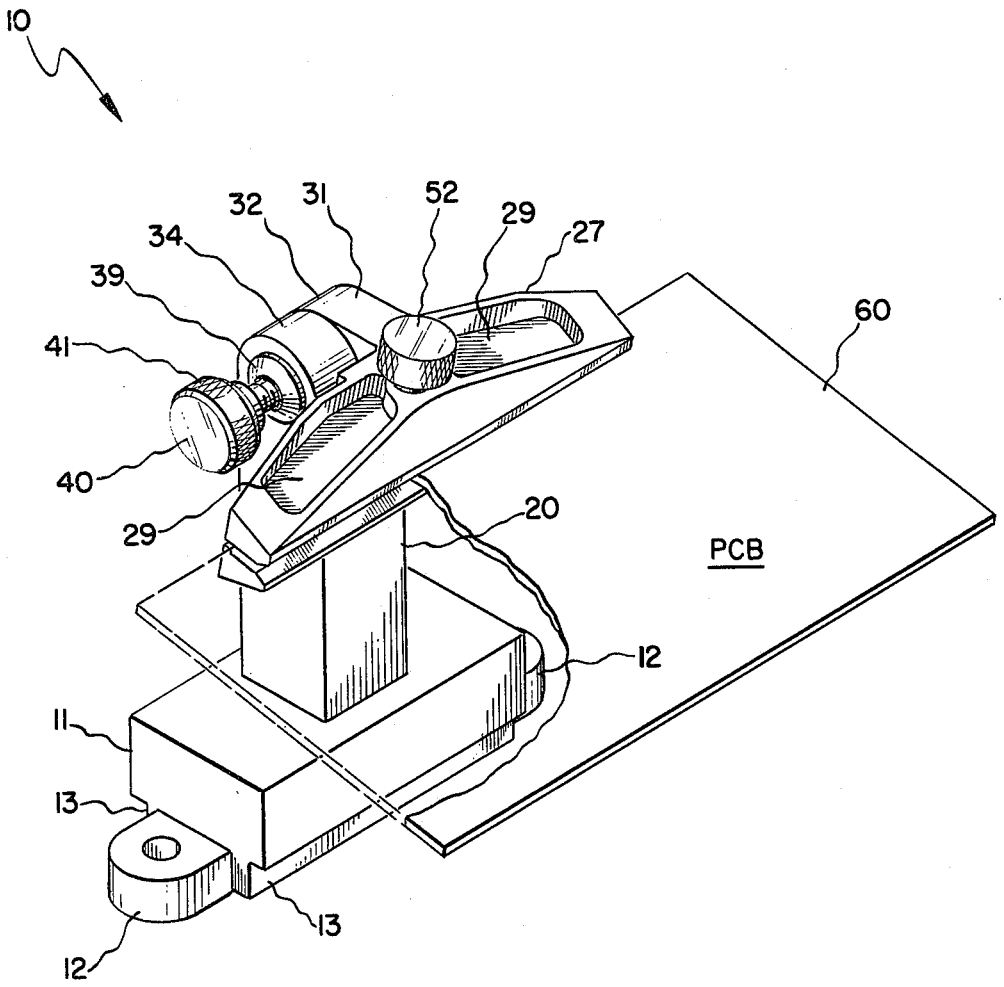
FIG. 1 is a perspective view of one form of holder in accordance with the invention shown holding a typical printed circuit board.

Referring now to the drawing, one embodiment of the printed circuit board holder of the invention is designated 10. It comprises a generally rectangular base member 11 having mounting lugs 12 extending from opposite ends for receiving screws or bolts (not shown) for mounting of the holder 10 on, for example, a workbench. In addition, the bottom section is narrowed or recessed as shown at 13 to enable the holder 10 to be mounted in a suitable vise which would grip just the recessed section 13. The rectangular part of the base 11 may be hollow or recessed to conserve material. Upstanding and integral with the base is a vertical post 15, which is generally cylindrical, except that the upper part designated 16 has a slight outward taper (widening toward the top), an annular protuberance 17 serving as a retaining ring, and a pair of crossed slots 18 extending vertically throughout the tapered section 16, which slots 18 provide flexibility or resilience of the tapered section 16.

Figure 3:
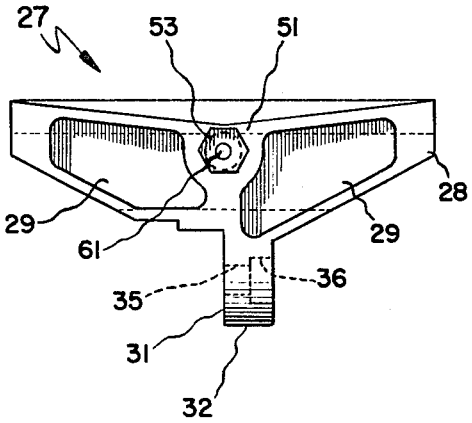
FIG. 3 is an exploded view of the three main parts making up the holder depicted in FIGS. 1 and 2.

The center part of FIG. 3 comprises a vertical member 20 having a central bore 21 with a bevelled edge 22 adapted to receive the post 15. The bore 21 is provided with an annular recess 23 adapted to receive the retaining ring 17 on the post. During assembly, when the center part 20 is pushed down over the post 15, the tapered section 16 moves inward allowing the post 15 to enter the bore 21 until the retaining ring 17 snaps into the recess 23, allowing the tapered section to flex outward slightly providing a holding biasing force. The natural resilience of the tapered section 16 provides a snug or friction fit between parts 20 and 15, yet also allows full 360° rotation, in either direction, of part 20 around the fixed post 15, designated by the arrows 25 in FIG. 2, and also causes part 20 to hold due to the friction fit any position to which it is rotated. The part 20 may conveniently have a square or rectangular cross-section to aid in its rotation by the user.

Figure 4:
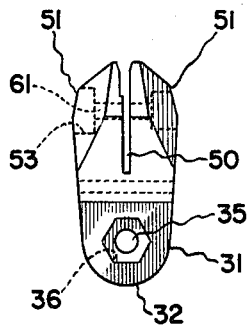
FIG. 4 is a side view of the upper holding jaws part of FIG. 3.

The upper end of the center part 20 is recessed to form an upwardly extending lug 26 on which will be mounted the jaw section 27 depicted at the top of FIG. 3. The jaw section 27, shown upright in FIG. 3, comprises a generally triangular, or truncated triangular section 28 having cut-outs 29 to conserve material, and has depending from its bottom, offset from the center, a similarly configured lug 31 for being received on the shoulder 30 formed by the offset lug 26 of the center section. As shown in FIG. 4, which is a side view of the jaws 27, the bottom of the lug 31 is rounded as shown at 32. The upper part 34 of lug 26 is similarly rounded (see FIG. 1). In the lug 31 is a hole 35, which at one side is hexagonally recessed 36 to receive a nut (not shown) which seats in the recess 36. The nut is adapted to be engaged by a pivot screw 40, with a knurled end 41 for ease of rotation by a user. The screw part extends through the hole 42 in lug 26 and hole 35 in lug 31 and engages the threads of the nut seated in recess 36. A bowed or Bellville spring washer 39 (FIG. 1) may be interposed between pivot screw head 41 and the facing side of lug 26 so that adjustable tension or a biasing force can be applied between the two lugs when the screw 40 is tightened. Thus, the jaw member 27 can be rotated or pivoted around the screw 40 axis from the position shown in FIG. 2 in solid lines, as indicated by arrow 45, over an arc in the vertical plane more than 180° to the opposite position shown in dashed lines in FIG. 2. A preferred angle is about 200°, that is to say, about 10°–15° below the horizontal on either side of FIG. 2. This pivotable movement is accomplished by rotating part 27, with the desired tension set by pivot screw 40 tightening the bowed spring washer 39. This approximately 200° of rotation is a result of the curved ends 32, 34 of the mating lug parts, the dimensioning of the shoulder 30, and location of a jaw screw 52, to be described later. FIGS. 3 and 4 are to scale and illustrate one form of dimensioning to achieve this result. The jaws 27 can be locked in any position over its full pivot range by simply hand tightening pivot screw 40. The bevel washer 39 or similar resilient device enables controlled tension to be applied by the pivot screw 40 to hold the jaws 27 in the desired position, which is necessary depending upon the size and weight of the printed circuit board, which in turn depends upon the number of electrical components mounted on the board.

Figure 5:
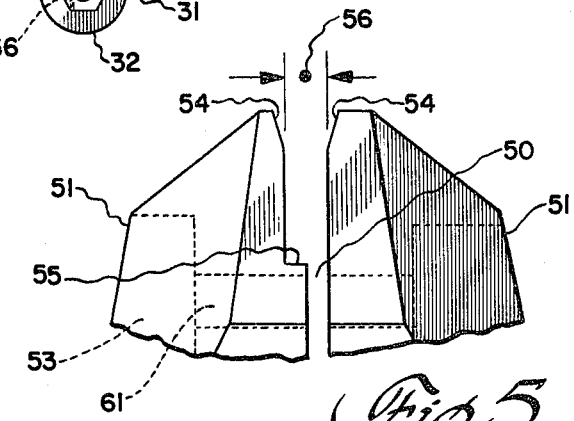
FIG. 5 is an enlarged detail side view of the holding jaw configuration.
Figure 6:
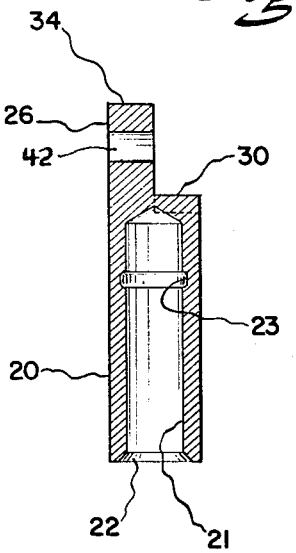
FIG. 6 is a partial top view of the base post member.
Figure 6:
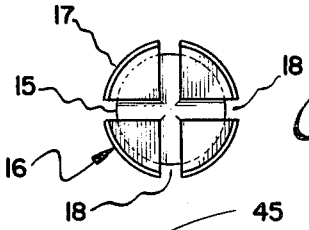

The jaw section 27 has a slot 50 (see FIG. 4) extending approximately one-half of its depth which allows for limited flexing of the two jaw halves 51 thus formed. The jaws 51 in turn can be tightened by means of a jaw screw 52 which passes through a hole 61 in one jaw 51, above the slot 50 bottom, and is screwed into a nut (not shown) mounted in a hexagonally recessed section 53 of the other jaw 51. In this case, suitable tension or bias is applied by a small compression spring 49 mounted on the screw (FIG. 2) to enable adjustable spring pressure to be applied to the jaws 51 when screw 52 is tightened, to provide a variable holding force by the jaws on the board, depending again on its size and weight. As detailed in the enlarged view of FIG. 5, the jaw edges are bevelled at 54 to ease insertion of the board, and a step 55, which limits the distance the printed circuit board enters the jaws, is recessed in the left jaw 51, defining a slot spacing indicated by numeral 56 slightly larger than the board thickness for which the device is intended. For instance, for a standard board thickness of 1/16 inches (1.6 mm), the spacing 56 in the unclamped jaws 51 is 0.062 inches. The spring 49 allows the jaws to spread to accommodate small variations of board thickness. For different board thicknesses, the slot spacing 56 would be correspondingly altered. With a jaw length of about 2.80 inches, printed circuit boards of up to 10 inches long can be effectively held.

The parts described can be constructed of various materials. For low cost manufacture, the parts illustrated in FIGS. 3–6 can be made, for example, of ABS plastic, and the screws, washers, springs and nuts of suitable metal.

Figure 2:
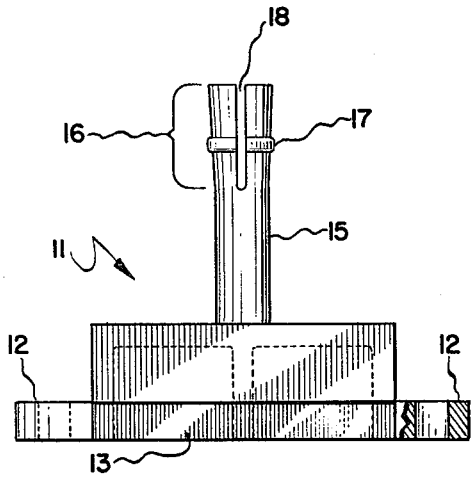
FIG. 2 is a side view of the holder with the board, showing in phantom the pivotable action of the holding jaws.
Figure 2:
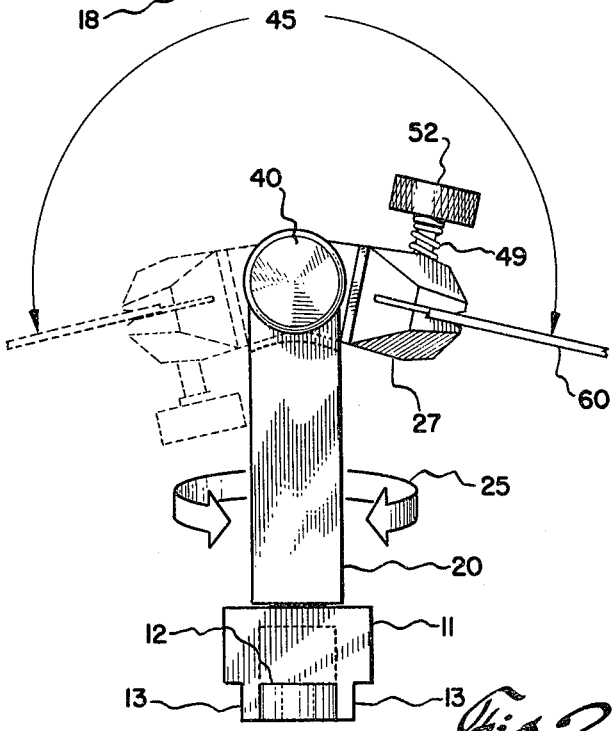

FIG. 1 illustrates the holder 10 holding a PCB or printed circuit board 60 in a position corresponding to the solid line position of the holding jaws 27 in FIG. 2. As noted, the part 20 is rotatable in a horizontal plane over a full 360° to locate the board in any horizontal position, and the jaws 27 are pivotable over the 200° mentioned so that the board can be positioned in any vertical position desired, giving full access to both sides of the board 60. Usually, once the pivot screw 40 has been set at the proper tension, the jaws 27 can be pivoted and will hold in any position without further adjustment or locking of pivot screw 40. It will also be evident that the simplicity and compactness of the design will lend itself to low cost manufacture and packaging.

As will be evident from the foregoing description, the holder of the invention offers the following advantages over the known devices. The design is simple, of small size, and capable of low cost manufacture. It can be mounted to a workbench or held in a conventional bench vise. The adjustable spring loaded jaws provide controlled, secure holding of boards of varying thickness and weight. Full 360° rotation with friction holding is available in a horizontal plane, plus greater than 180° pivoting in a vertical plane.

While a preferred embodiment has been described, other variations will be evident to the skilled artisan. For instance, other means of providing resilience with the applied screw pressure can be substituted for the spring or bowed washer described.

While my invention has been described in connection with specific embodiments thereof, those skilled in the art will recognize that various modifications are possible within the principles enunciated herein and thus the present invention is not to be limited to the specific embodiments disclosed.

In FIG. 1, pivot screw 40 is shown partially withdrawn to show bowed washer 39. Similarly, in FIG. 2, jaw screw 52 is shown partially withdrawn to show spring 49 more clearly. In actual use, as above described, both screws 40 and 52 would be tightened down to provide the necessary holding forces desired.

What is claimed is:

1. A printed circuit board holder comprising a base member having mounting means comprising means including a bottom surface for supporting the base member on a work surface and means adapted for clamping the base member in a vise, an upwardly-extending support member rotatably mounted on the base member and rotatable over a full 360° in a horizontal plane, said rotatable mounting comprising a fixed post on one of the support member and the base member, and a bored member for receiving and frictionally engaging the fixed post on the other of the support member and base member, said post being resilient and having a slightly outwardly tapered slotted end and a substantially annular protuberance thereon, and the bored member having an annular recessed section for receiving the annular protuberance on the tapered end of the post when the latter engages the bore on the bored member in a frictionally-engaging relationship, thereby allowing the full 360° rotation of the support member about the base member while permitting the support member to firmly hold any set position without the need for external clamping, a board holding member pivotably mounted on the end of the rotatable support member and having spring-biased opposed jaws for receiving and clamping an extended edge portion of a printed circuit board, means for adjusting the spring biasing of the opposed board receiving jaws, and means for holding the pivotable mounting of the board holding member in a selected pivotable position, said pivotable mounting being configured to allow pivoting of the clamped board in a vertical plane over an angle exceeding 180°.

2. A printed circuit board holder as claimed in claim 1 wherein the pivotable mounting of the board holding member on the support member comprises mating parts having rounded sections configured to allow pivoting of the board holding member from a first position below a horizontal line over an arc exceeding 180° to a second position below the same horizontal line, and further comprising means for adjustably controlling the biasing pressure between the mating parts and for selectably locking the mating parts in any selected position over its full arc of travel.

3. A printed circuit board holder as claimed in claim 2 wherein the mating parts are configured to allow pivoting of the board holding member over an arc of about 200°.

4. A printed circuit board holder as claimed in claim 2 wherein the clamping jaws for the extended board edge portion comprises a slotted member with the slot dimensioned to receive the board edge portion, and means for releasably clamping the jaws onto the board edge portion.

5. A printed circuit board holder as claimed in claim 4 wherein the releasable clamping means comprises a spring-biased manually operable screw engaging the jaw edges across its slot.

6. A printed circuit board holder as claimed in claim 5 wherein the slot in the board holding member has a step and bevelled ends to ease insertion of the board.

7. A printed circuit board holder as claimed in claim 11 wherein all of the major components of the holder are constituted of a plastic resin.

8. A printed circuit board holder as claimed in 1 wherein the means adapted for clamping the base member in a vise comprises a narrowed portion on the base member adjacent the bottom surface.

* * * * *